US012398522B2

(12) United States Patent
Barrientos et al.

(10) Patent No.: US 12,398,522 B2
(45) Date of Patent: Aug. 26, 2025

(54) SELECTABLE-WIDTH PUSH PLOW

(71) Applicant: Ralph Barrientos, Morris Township, NJ (US)

(72) Inventors: Ralph Barrientos, Morris Township, NJ (US); Matthew Sommerfield, Allentown, PA (US); Brendan Haentjens, Goleta, CA (US); James Weiler, Bethlehem, PA (US)

(73) Assignee: Ralph Barrientos, Morris Township, NJ (US)

( * ) Notice: Subject to any disclaimer, the term of this patent is extended or adjusted under 35 U.S.C. 154(b) by 879 days.

(21) Appl. No.: 17/429,691

(22) PCT Filed: Feb. 20, 2020

(86) PCT No.: PCT/US2020/019029
§ 371 (c)(1),
(2) Date: Aug. 10, 2021

(87) PCT Pub. No.: WO2020/172402
PCT Pub. Date: Aug. 27, 2020

(65) Prior Publication Data

US 2022/0205200 A1 Jun. 30, 2022

Related U.S. Application Data

(60) Provisional application No. 62/807,824, filed on Feb. 20, 2019.

(51) Int. Cl.
*E01H 5/02* (2006.01)

(52) U.S. Cl.
CPC ..... *E01H 5/02* (2013.01)

(58) Field of Classification Search
CPC .... E01H 5/02; E01H 5/04; E01H 5/10; E01H 5/12; A01B 1/02
See application file for complete search history.

(56) References Cited

U.S. PATENT DOCUMENTS 2,432,780 A * 12/1947 Mader ..... E01H 5/02 37/283
2,728,598 A 12/1955 Szillage
(Continued)

FOREIGN PATENT DOCUMENTS

CN 2775129 4/2006
CN 2775129 Y * 4/2006
(Continued)

OTHER PUBLICATIONS

International Search Report mailed May 22, 2020, in International Application No. PCT/US2020/019029.
(Continued)

*Primary Examiner* — Christopher J Sebesta
*Assistant Examiner* — Blake E Scoville
(74) *Attorney, Agent, or Firm* — FisherBroyles LLP

(57) ABSTRACT

A selectable-width push plow for removing snow or other material. The push plow is configurable in any one of several pre-defined blade-width blade configurations without requiring special tools or great dexterity to adjust, while also allowing for compact storage of the device. The push plow includes a plow blade having a first panel and a second panel pivotably interconnected to the first panel. The second panel is pivotable between a retracted position in which the bottom edges of the first and second panel extend transversely to one another, and an extended position in which the bottom edges of the first and second panel extend in a common direction. The push-plow further includes an adjustable-length handle extend substantially vertically the plow blade and a glide adjacent the bottom of each panel to promote gliding of push plow over concrete, macadam or another rough or uneven surface.

26 Claims, 6 Drawing Sheets

(56) References Cited

U.S. PATENT DOCUMENTS

| | | | | | |
|---|---|---|---|---|---|
| 3,431,661 | A * | 3/1969 | Carlson | E01H 5/02 | 37/278 |
| 3,526,979 | A | 9/1970 | Ladewski | | |
| 4,878,704 | A * | 11/1989 | Jacanin, Jr. | E01H 5/02 | 294/51 |
| 4,991,324 | A * | 2/1991 | Fine | E01H 5/02 | 37/270 |
| 5,228,734 | A * | 7/1993 | Pollastro | E01H 5/02 | 294/51 |
| 5,493,797 | A * | 2/1996 | Jackson | E01H 5/02 | 37/285 |
| 5,511,328 | A * | 4/1996 | Fingerer | E01H 5/02 | 37/285 |
| 5,676,412 | A * | 10/1997 | Kahley | E01H 5/02 | 294/54.5 |
| 6,269,558 | B1 * | 8/2001 | Alexander | E01H 5/02 | 37/278 |
| 7,237,814 | B2 * | 7/2007 | Handzlik | E01H 5/02 | 294/51 |
| 8,800,175 | B1 * | 8/2014 | Faraci | E01H 5/02 | 37/285 |
| 8,955,238 | B1 * | 2/2015 | Castruccio | E01H 5/061 | 37/231 |
| 9,611,603 | B2 * | 4/2017 | Fernandez, Sr. | A01B 1/222 | |
| 2013/0139414 | A1 * | 6/2013 | Hogenson | E01H 5/02 | 37/266 |
| 2014/0132015 | A1 | 5/2014 | Stachowski | | |
| 2015/0040441 | A1 | 2/2015 | Nammensma | | |
| 2015/0284929 | A1 * | 10/2015 | Behan | E01H 5/061 | 16/110.1 |
| 2015/0330044 | A1 | 11/2015 | Ramcharan | | |
| 2016/0222613 | A1 | 8/2016 | Stoddart | | |
| 2017/0156260 | A1 | 6/2017 | Fernandez, Sr. | | |
| 2017/0362789 | A1 | 12/2017 | Lovell | | |

FOREIGN PATENT DOCUMENTS

| | | | |
|---|---|---|---|
| CN | 202390800 | | 8/2012 |
| CN | 202390800 U | * | 8/2012 |

OTHER PUBLICATIONS

Worx WA0230 AeroCart Wheelbarrow Snow Plow, Amazon product page, retrieved online on Aug. 6, 2021 from <<https://www.amazon.com/Worx-WA0230-AeroCart-Wheelbarrow-Snow/dp/B00N0I9SX4>>.

Written Opinion of the International Searching Authority mailed May 22, 2020, in International Application No. PCT/US2020/019029.

Canadian Office Action mailed Mar. 5, 2025, in Canadian Application No. 3,130,614.

* cited by examiner

SELECTABLE-WIDTH PUSH PLOW

CROSS-REFERENCE TO RELATED APPLICATION

This application is a national stage application of International Application No. PCT/US2020/019029, filed Feb. 20, 2020, which claims the benefit of priority under 35 U.S.C. § 119 (e) of U.S. Provisional Patent Application No. 62/807,824, filed Feb. 20, 2019, the entirety of which is hereby incorporated herein by reference.

FIELD OF THE INVENTION

The present invention relates generally to shovels, and more particularly, to a new and useful selectable-width shovel in the nature of a plow allowing for use as a push plow to remove snow or other material in both narrower- and broader-width passes, while also allowing for storage of the device in a compact state.

BACKGROUND

Various shovels are known in the art for lifting, pushing or otherwise moving a material from one location to a second location. With respect to the shovel's blade structure, there are two main types of shovels. The first type is mainly configured for use to lift and transport material, such as dirt, and the second type is mainly configured mainly for use to push material like a plow.

A common use for a shovel is use to remove snow, which can be wet, slushy, or icy, and particularly heavy, making removal of the snow by lifting undesirable. Snow removal tasks are typically conducted in cold, raining and/or snowing/sleeting environmental conditions, which is particularly unpleasant for the person performing the snow removal task. There have been attempts in the prior art to provide a user with a shovel having a broadened (wider-width) blade to increase the width of a single pass of the shovel, and thereby to remove relatively more snow in a single pass. This is intended to ultimately reduce the amount of time required to clear a given area, and thus to reduce the amount of exposure to undesirable environmental conditions. However, an increase of the blade's width that improves performance and/or suitability in wider-width areas (e.g., a driveway) correspondingly degrades performance and/or suitability in narrower-width areas narrower than the blade (e.g., on a walkway).

Additionally, increasing the blade's width may improves performance by allowing for movement/removal of more snow in a single path, but is corresponding increases the weight of the snow being moved/removed, and thus requires more physical strength to operate. This may make the shovel more desirable for certain users with sufficient physical strength to handle the increased weight, but it correspondingly makes the shovel less desirable for those users with insufficient physical strength to handle the increased weight.

Further still, shovels with broader blade widths may be more desirable during use to remove snow more quickly, but may be less desirable when not in use, as more width is required to store the wider-width shovel blade. This makes a wider-width shovel more difficult to store, and hand tools such as these are likely in storage approximately 99% or more of the time, and are likely in use approximately 1% or less of the time.

What is needed is a shovel that does not require the user to lift the weight of snow or other material that allows for material removal in broader-width and narrower-width passes, and that can be stored in a compact state.

SUMMARY

The present invention provides a push plow-type shovel for removing snow or other material in a user-selectable fashion, allowing for selection from among both narrower- and broader-width shovel configurations for making corresponding narrower- and broader-width passes, preferably without requiring special tools or great dexterity to adjust, while also allowing for storage of the device in a compact state.

An exemplary push plow comprises: a plow blade and a handle. The plow blade comprises: a first panel having top and bottom edges, and side edges extending between the top and bottom edges; and a second panel having respective top and bottom edges, and respective side edges extending between its top and bottom edges, the second panel being pivotably interconnected to the first panel, the second panel being pivotable between a retracted position in which the bottom edges of the first and second panel extend transversely to one another, and an extended position in which the bottom edges of the first and second panel extend in a common direction. The handle is mounted to the first panel, and extends substantially vertically from the first panel when the first panel is in a substantially vertical position.

BRIEF DESCRIPTION OF THE FIGURES

An understanding of the following description will be facilitated by reference to the attached drawings, in which.

DETAILED DESCRIPTION

The present invention provides a push plow for manual use to remove snow or other material from a surface, such as a driveway or walkway. As a push-plow-type shovel, large amounts of snow or other material can be removed without requiring the user to lift the weight of the material being removed. The push-plow is specially configured to have a multi-segment blade. The segments can be manually manipulated easily, and in certain embodiments without the use of any tools, to place the push plow in any selected one of several configurations. Collectively, the configurations include both narrower- and broader-width configurations for making corresponding narrower- and broader-width passes with the push plow.

Accordingly, the push plow may be selectively configured by the user as desired, to make relatively broader passes in wider-width areas (e.g., a driveway) when desired, or to make relatively narrower passes in narrower-width areas (e.g., a walkway) when needed. Further, the push plow may be selectively configured by the user as desired, to make relatively broader passes when the user has sufficient physical strength to move snow in a broader pass, e.g., depending upon the depth of a particular snow accumulation, or to make relatively narrower passes when the user has insufficient strength to do so. Further still, the push plow may be used in a relatively broader-blade state, and yet make also be stored in a more company states, requiring less width than the full width of the blade in its broadened state.

Referring now to FIGS. 1-6, an exemplary embodiment of a selectable-width push-plow 100 in accordance with the present invention is shown. As will be appreciated from FIGS. 1-6, the exemplary push plow 100 principally includes a plow blade 20 and a handle 80. In use, a user can grasp the handle and push the push plow 100 to cause the plow blade 20 to ride across the ground or other surface to push snow/material along and clear snow/material from the ground/surface.

In accordance with the present invention, the push plow has a multi-segment plow blade. In this exemplary embodiment, the plow blade 20 includes three distinct panels 20*a*, 20*b*, 20*c*. In this configuration, the panels may be referred to herein as a first (central) panel 20*a*, a second (wing) panel, e.g., 20*b*, and a third (wing) panel, e.g. 20*c*. It will be appreciated that any number of two or more panels may be used, consistent with the present invention. Each panel has respective top edges 22*a*, 22*b*, 22*c*, respective bottom edges 24*a*, 24*b*, 24*c*, and respect side edges 26*a*, 28*a*, 26*b*, 28*b*, and 26*c*, 28*c*.

Figure 2:
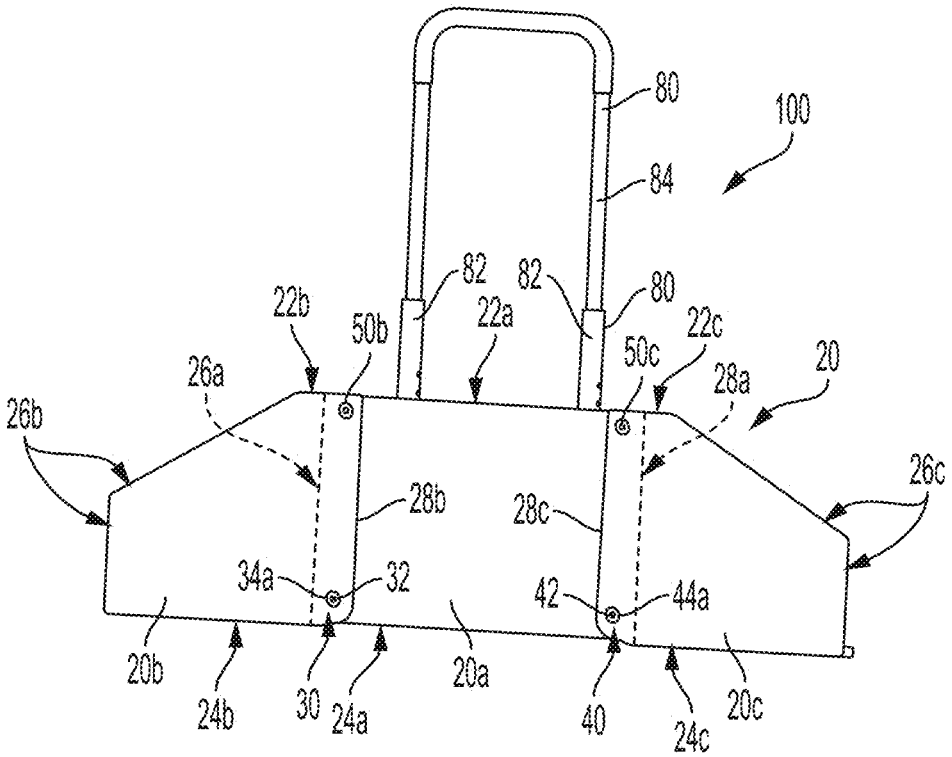
FIG. 2 is a front perspective view of the push-plow of FIG. 1, shown in its expanded state.
Figure 3:
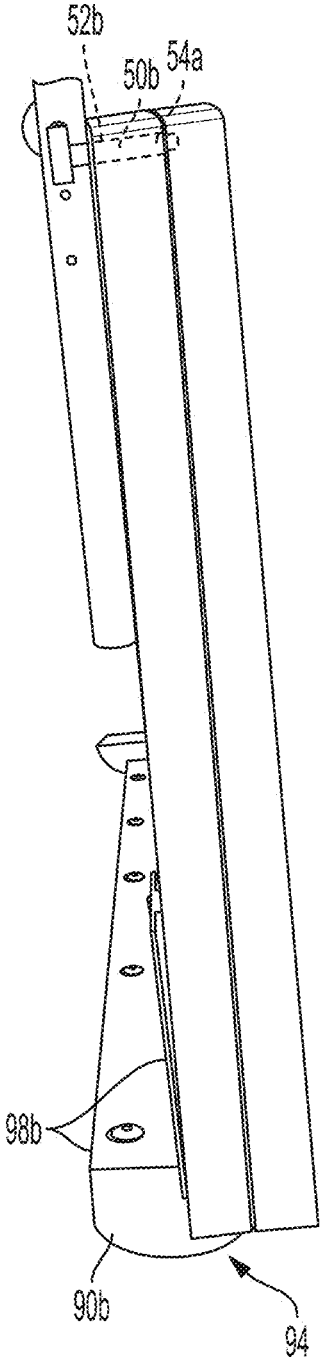
FIG. 3 is a right-side view of the push-plow as shown in FIG. 2.

These panels are pivotably interconnected so they can be manually manipulated relative to one another to place the push plow in any selected one of multiple configurations. For example, as best shown in FIG. 2, the first and second panels 20*a*, 20*b* are pivotably interconnected in this exemplary embodiment at a first pivot joint 30. The pivot joint 30 may include a central cylindrical section 32 acting as a pivot pin passing through openings defined in both panels. The central cylindrical section 32 may terminate in front and rear annular flanges 34*a*, 34*b*, with or with an annular spacer between the panels. Similarly, the first panels and third 20*a*, 20*c* are pivotably interconnected in this exemplary embodiment at a second pivot joint 40. The pivot joint 40 may include a central cylindrical section 42 acting as a pivot pin passing through openings defined in both panels. The central cylindrical section 42 may terminate in front and rear annular flanges 44*a*, 44*b*, with or with an annular spacer between the panels. Any suitable pivot joint may be used.

Accordingly, the second panel 20*b* is pivotably interconnected to the first panel 20*a* such that the second panel 20*b* is pivotable between a retracted position (shown in FIG. 1) in which the bottom edges 24*a*, 24*b* of the first and second panels 20*a*, 20*b* extend transversely to one another (an shown in FIG. 1), and an extended position (as shown in FIG. 2) in which the bottom edges 24*a*, 24*b* of the first and second panels 20*a*, 20*b* extend in a common direction, e.g., horizontally as shown in FIG. 2. As used herein, "common direction" is used to in a non-limiting sense to mean generally in the same direction, such as generally horizontally, generally vertically, or generally parallel, to indicate that the bottom edges are both in position for gliding along a ground surface that may be perfectly flat, or may not be perfectly flat, as is often the case for outdoor surfaces such as driveways and walkways on which the push plow device is intended for use.

Similarly, the third panel 20*c* is pivotably interconnected to the first panel 20*a* such that the third panel 20*c* is pivotable between a retracted position (shown in FIG. 1) in which the bottom edges 24*a*, 24*c* of the first and third panels 20*a*, 20*c* extend transversely to one another (an shown in FIG. 1), and an extended position (as shown in FIG. 2) in which the bottom edges 24*a*, 24*c* of the first and third panels 20*a*, 20*c* extend in a common direction, e.g., horizontally as shown in FIG. 2.

In this exemplary embodiment, each panel is substantially planar. More particularly, a majority of the area of each panel is planar. For example, each panel may be constructed of a lightweight and relatively rigid material, such as corrugated plastic, which is planar. In embodiments in which the panels are planar, the panels may be pivotably interconnected to one another via a simple pivot joint, e.g. of the type described above although any suitable pivot joint may be used, to cause the first and second panels, and the first and third panels, to be substantially parallel to each other in both the retracted position and the extended position. The parallel orientation, particularly in the retracted position, contributes to the compact storage of the device, and allows the first panel to support the second and third panels during use, without placing undue stress on the second and third panels or the pivot joints.

Figure 1:
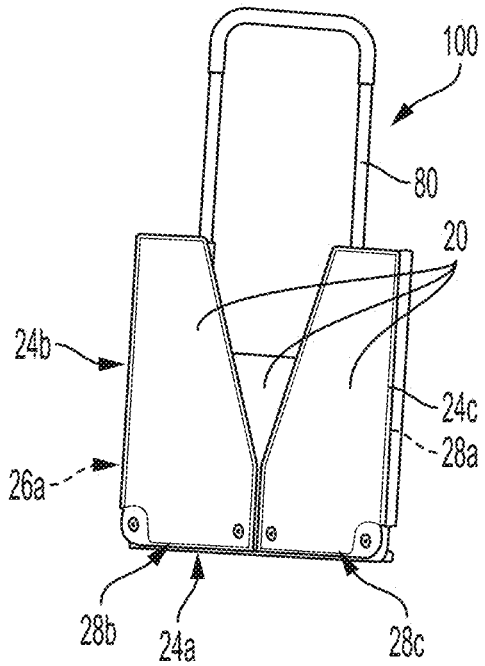
FIG. 1 is a front perspective view of a selectable-width push-plow in accordance with an exemplary embodiment of the present invention, shown in its compact state.

Further, in this exemplary embodiment, the first and second panels are pivotably interconnected proximally to an intersection of the side and bottom edges of both panels, as best shown in FIG. 2. For example, the pivot joint 30 provides pivotable interconnection of the first panel 20*a* and the second panel 20*b* in the lower right hand corner of the first panel 20*a*, near the intersection of side edge 26*a* and bottom edge 24*a* of panel 20*a*, and near the intersection of side edge 28*b* and bottom edge 24*b* of panel 20*b*. Accordingly, the first and second panels are pivotably interconnected so that the wing panels (e.g., second panel 20*b*) substantially overlie (e.g., at least 25%, or at least 50% or more of the panel overlies) the first panel 20*a* when in the retracted position, as shown in FIG. 1. Further, with this configuration, the second panel 20*b* does not substantially overlie (e.g., at least 25%, or at least 50% or more of the panel overlies) the first panel 20*a* when in the extended position, as shown in FIG. 2.

Figure 4:
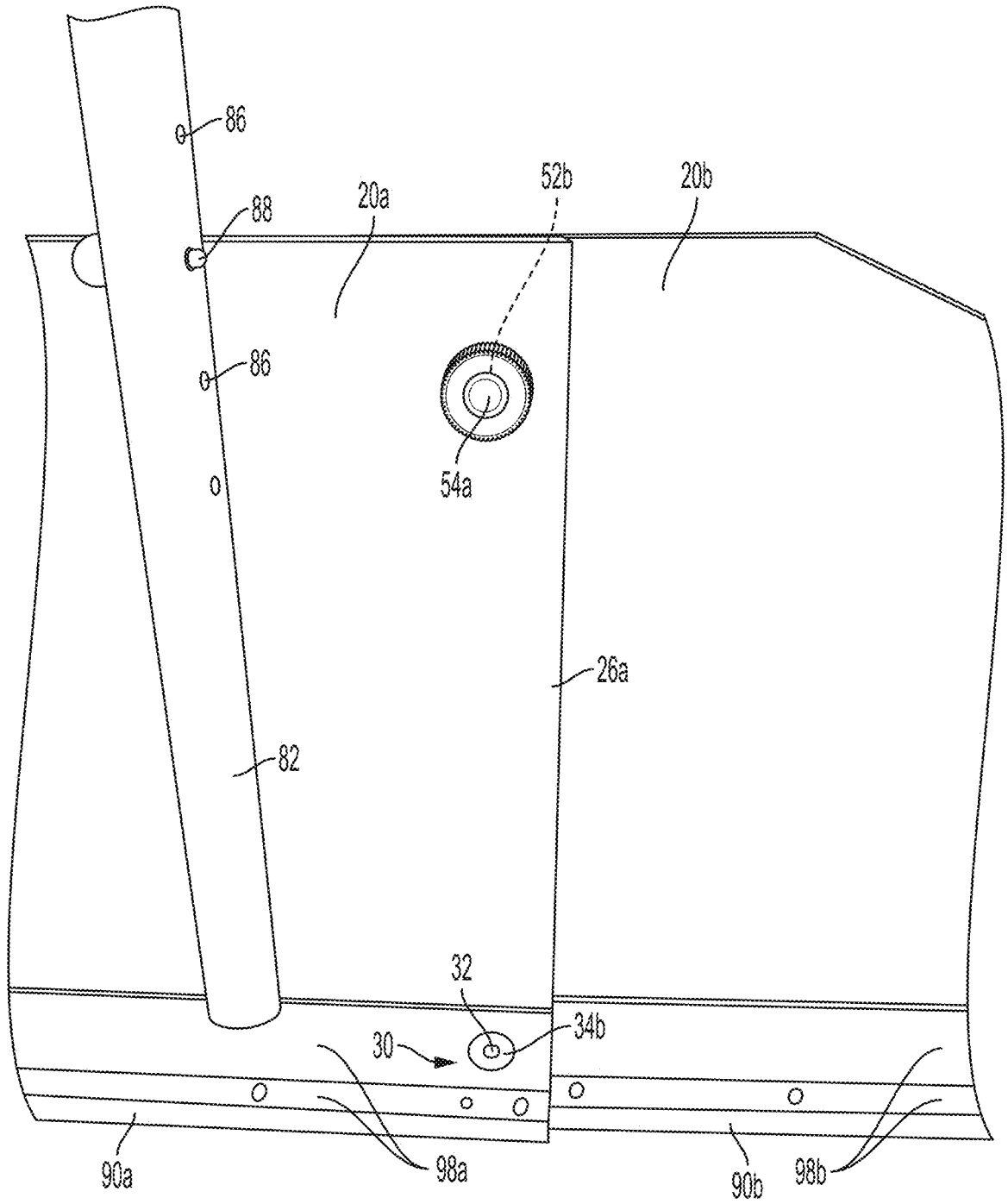
FIGS. 4 and 5 are partial rear views of the push-plow as shown in FIG. 2.

In a preferred embodiment, the pivot joints 30, 40 are spaced on the first/central panel 20*a* in coordination with the heights of the wing panels 20*b*, 20*c*, such that the wing panels 20*b*, 20*c* may be pivoted into retracted positions in a common place adjacent the central panel, and such that portions of the wing panels 20*b*, 20*c* do not interfere with one another during pivoting In the embodiment shown in FIGS. 1-6, each wing panel 20*b*, 20*c* further defines an opening 50*b*, 50*c* spaced from the opening for the pivot joint, e.g., along is respective top edge 22*b*, 22*c* in a position to align with a respective locking mechanism supported on the central panel 20*a* when each wing panel is in the extended position, with its respective bottom edge 24*b*, 24*c* extending in a common direction with the bottom edge 24*a* of the central panel 20*a*. The opening 50*b*, 50*c* may be reinforced with a plastic or metal ring, grommet, socket or the like for receiving the locking mechanism. The locking mechanism may be any suitable structure, such as a protuberance dimensioned to seat in the opening 50*b*, 50*c*, or, as best shown in FIG. 4, a locking pin 54*a*, 54*b* insertable through a corresponding opening 52*b*, 52*c* in the central panel 20*a* and through the openings 50*b*, 50*c* in the wing panels 20*b*, 20*c* to interlock the panels and fix their relative positions, as will be appreciated from FIGS. 2 and 4. In certain embodiments, the locking pin 54*a*, 54*b* comprises a T-handle ball lock pin having a push-button operable to cause a ball to protrude or to be depressable relative to the surface of the pin, and one or both of the central panel 20 and wing panels 20*b*, 20*c* defines a socket comprising a ramp and/or shoulder that is engageable by the ball of the pin, such that when the pin 54 is seated properly in the central 20 and wing 20*b*/20*c* panels, the ball engages the socket such that is causes the central 20 and wing 20*b*/20*c* panels to be drawn toward and/or against one another by the action of the ball and the socket, to provide added rigidity to the plow blade 20, in either one or both of the extended and retracted positions of the wing panels.

In one embodiment, the push plow 100 includes may include a spring-biased mechanism for biasing the wing panels toward their extended positions. The mechanism may include springs and/or cams. In one embodiment, a torsion spring is provided at each pivot joint 30 and the spring is tensioned/biased to resist movement toward the retracted position (FIG. 1), and to urge movement toward the extended position (FIG. 2). This can be advantageous, for example, for aiding in maintaining contact of the wing panels 20*b*, 20*c* with curved and/or uneven ground surfaces. in one or both of the retracted (FIG. 1) and extended (FIG. 2) positions. Accordingly, the wing panels 20*b*, 20*c* may be spring-biased to retain each panel in at least one of the retracted position and the extended position.

As described above, the push plow 100 includes a handle 80 in addition to the plow blade. The handle 80 is mounted to the plow blade to cause it to extend substantially vertically from the plow blade with the plow blade is in a substantially vertical position. In the exemplary embodiment shown, the handle comprises is length adjustable, and includes a handle mount 82 fixedly mounted to the first panel 20*a*, and a handle 84 nested with and slidable relative to the handle mount 82, such that the handle mount and handle can be interlocked to provide a handle of a desired length. Preferably, at least one of the handle mount 82 and the handle 84 define a plurality of spaced openings 86 that may be used selectively to interlock the handle mount 82 and handle 84 in selected relative longitudinal positions.

Figure 5:
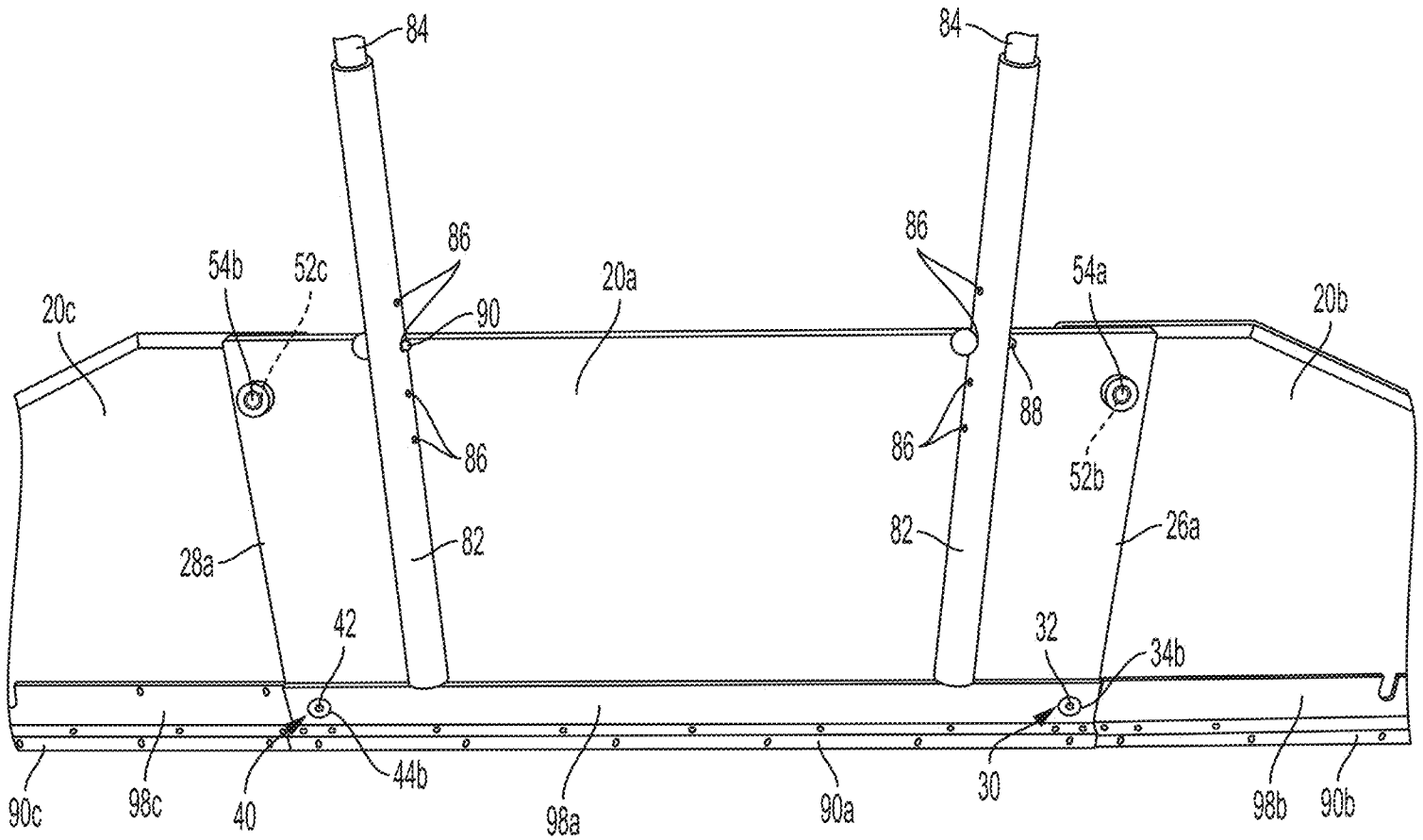
Figure 6:
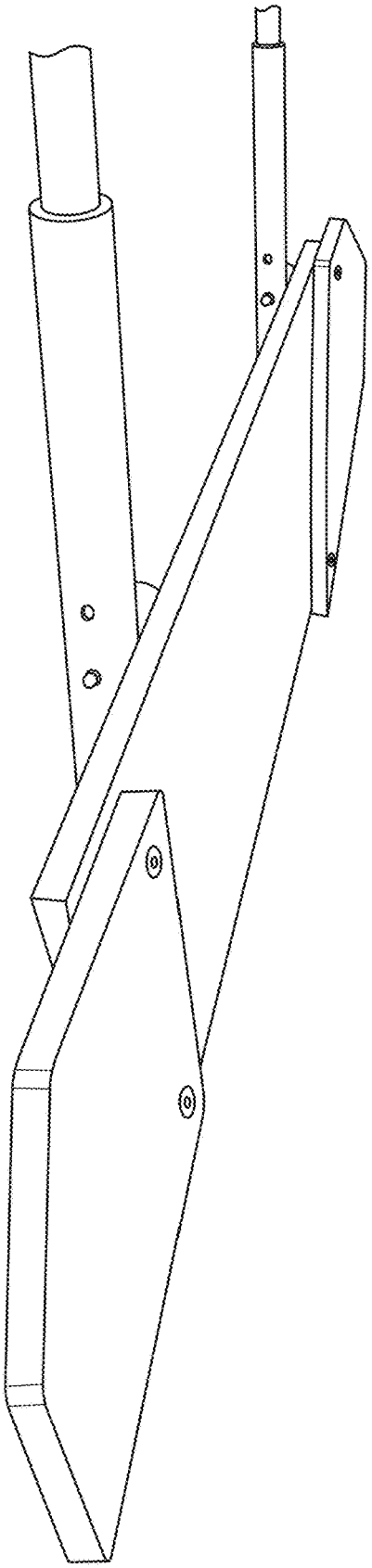
FIG. 6 is a right-side perspective view of the push-plow as shown in FIG. 2.

In the exemplary embodiment shown, both of the handle mount 82 and the handle 84 define a plurality of spaced openings 86, and the push plow 100 further includes a detent mechanism for interlocking the adjustable handle 84 with the handle mount 82 fixed to the plow blade, to adjust the length of the handle. In one embodiment, the detect mechanism comprises a locking pin 88 (with a ball detent) insertable through aligned openings in the handle mount 82 and handle 84, as best shown in FIGS. 4 and 5. In an alternative embodiment, the handle houses a button clip operable to engage aligned openings of the handle mount 82 and handle 84. Any suitable detent mechanism may be used for this purpose.

Figure 7:
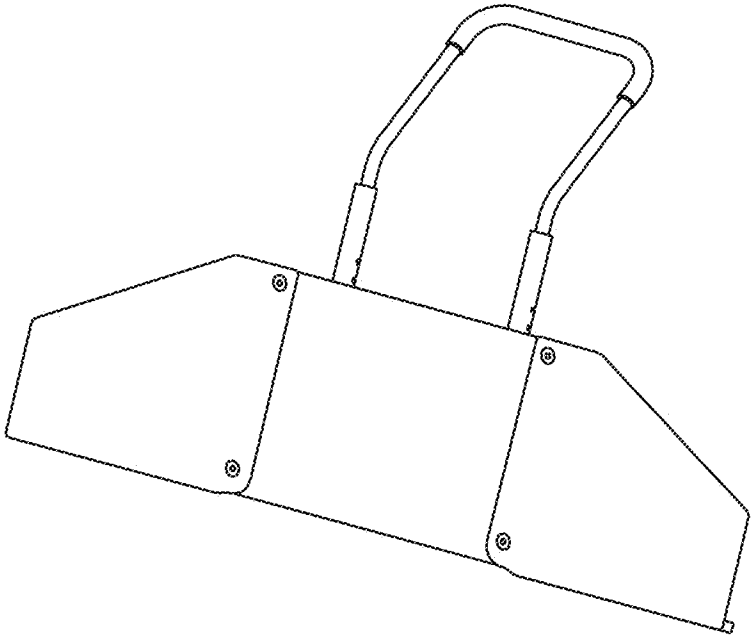
FIG. 7 is a front perspective view of an alternative embodiment of the selectable-width push-plow of the present invention, shown in its expanded state.

FIG. 7 is a front perspective view of an alternative embodiment of the selectable-width push-plow of the present invention, shown in its expanded state. This embodiment is similar to that of FIGS. 1-6 but has a different handle. In particularly, the canted handle 86 of FIG. 7 has a first portion 86*a* configured for receipt in the handle mount 84, and a second portion 86*b* that extends in a direction at an oblique angle relative to the first portion. The angled aspect of the canted handle may contribute to use comfort during use.

In both embodiments of the push plow 100 shown in FIGS. 1-7, the push plow 100 may further include a glide 90*a*, 90*b*, 90*c* supported adjacent the bottom edge 24*a*, 24*b*, 24*c* of each of the first, second and third panels 20*a*, 20*b*, 20*c*. The glide 90*a*, 90*b*, 90*c* is provided to promote gliding of the panels 20*a*, 20*b*, 20*c* of the push plow 100 over a rough surface, such as concrete, macadam or other material from which the push plow is to be used to remove snow, etc. The glide 90*a*, 90*b*, 90*c* may be constructed of plastic and/or have a smoothed or rounded leading edge 94 to promote gliding of the push plow 100 over the rough surface, which may be particularly helpful if the surface includes cracks and/or uneven portions.

Optionally, the push plow 100 may have a metallic brace 98*a*, 98*b*, 98*c* adjacent the bottom edges 24*a*, 24*b*, 24*c* of each of the panels 20*a*, 20*b*, 20*c*, which adds rigidity, as best shown. Each brace 98 may comprise a ⅛" thick L-channel aluminum with 2" legs supported along the bottom edge that supports the panels 20*a*, 20*b*, 20*c*, pivot joints 30, 40, and glides 90*a*, 90*b*, 90*c*.

In use, the push plow 100 may, for example, be removed from storage in a compact configuration, as shown in FIG. 1. The push plow 100 may then be readied for use by manually manipulating the panels as desired to place the push plow in any selected one of multiple well-defined operative configurations. In the first configuration, neither wing panel 20*b*, 20*c* is extended (both are in the retracted position) and the push plow 100 has its narrowest width, as shown in FIG. 1. In its second configuration, one wing panel (either 20*b*, 20*c*) is extended (and the other is in the retracted position) so that the push plow has an intermediate width. In its third configuration, both wing panels 20*b*, 20*c* are extended, as shown in FIG. 2, so that the push plow has its maximum blade width. It may be desirable to operate or store the push plow in any one of these three configurations, but it may be particularly desirable to operate the push plow in the third (broadest-width) configuration and to store the push plow in the first (narrowest-width) configuration, for compact storage.

To move a wing panel 20*b*, 20*c* from a retracted position to an extended position, the user may simply manually grasp the corresponding wing panel and pivot it about its respective pivot joint 30, 40 until the wing panel reaches the extended position in which the bottom edge 24*b*, 24*c* of the wing panel 20*b*, 20*c* extends in a common direction with the bottom edge 24*a* of the central panel 20*a*. At this point, the corresponding openings 50*b*, 52*b* of the first and second panels 20*a*, 20*b* or openings 50*c*, 52*c* of the first and third panels 20*a*, 20*c* will align. The user may then insert the locking pin 54*a*, 54*b* through the openings of the relevant panels to interlock the respective central and wing panels and interlock them in the desired operative position. The plow blade 20 is thereby readied for use.

The handle may be adjusted by disengaging any locking pin 89 or button clip from openings 86, and then sliding the handle 84 relative to the handle mount 82 until the openings realign at a desired handle length. The handle may then be locked into place by re-engaging any locking pin 89 or button clip in the aligned openings 86.

The push plow 100 may then be used by grasping the upper portion of the handle 84, positioning the push plow 100 with the glide(s) 90*a*,90*b*,90*c* on the ground surface to be cleared of snow, etc., and then sliding/driving/pushing the push plow 100 over the ground surface to clear it of snow, etc. If at any point it is desired to use the push plow in a configuration providing a broader or narrower-width plow blade, the panels can be manipulated as described above to place the push plow in another of its predefined operative configurations. Accordingly, the push plow may be adjusted to accommodate different users with different degrees of physical strength, or to accommodate a single user across different snowfalls or weights of snowfalls, and/or to plow wider-width or narrower-width areas, as desired. Accordingly, the push plow 100 can be used for removing snow or other material in a user-selectable fashion, allowing for selection from among both narrower- and broader-width plow blade configurations for making corresponding narrower- and broader-width passes, without requiring special tools or great dexterity to adjust.

After use, the wing panels 20*b*, 20*c* may be manipulated in a similar manner to place the push plow into its narrowest-width configuration to allow for storage of the device in a compact state, if desired.

Having thus described a few particular embodiments of the invention, various alterations, modifications, and improvements will readily occur to those skilled in the art. Such alterations, modifications, and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

The invention claimed is:

1. A push plow comprising:

a plow blade, the plow blade comprising:

a first panel having top and bottom edges, and side edges extending between the top and bottom edges;

a second panel having respective top and bottom edges, and respective side edges extending between its top and bottom edges, the second panel being pivotably interconnected to the first panel to pivot about an axis extending transversely to a front surface of the second panel, the second panel being pivotable about the transversely-extending axis between a retracted position in which the bottom edges of the first and second panel extend transversely to one another and a major portion of the second panel overlies the first panel, and an extended position in which the bottom edges of the first and second panel extend in a common direction and the major portion of the second panel does not overlie the first panel; and a handle mounted to the first panel, the handle extending substantially vertically from the first panel when the first panel is in a substantially vertical position.

2. The push plow of claim 1, wherein the first panel and the second panel are substantially planar.

3. The push plow of claim 2, wherein the first panel and the second panel are pivotably interconnected to be substantially parallel to each other in both the retracted position and the extended position.

4. The push plow of claim 1, wherein the first panel and the second panel are pivotably interconnected proximally to an intersection of the side and bottom edges of both panels.

5. The push plow of claim 1, wherein each of the first and second panels is constructed of corrugated plastic.

6. The push plow of claim 1, wherein the first and second panels are pivotably interconnected so that the second panel substantially overlies the first panel in the retracted position, and so that the second panel does not substantially overlie the first panel in the extended position.

7. The push plow of claim 1, wherein the second panel is spring-biased to retain the second panel in at least one of the retracted position and the extended position.

8. The push plow of claim 1, wherein the handle comprises:

a handle mount fixedly mounted to the first panel;

a handle body nest with and slidable relative to the handle mount.

9. The push plow of claim 8, wherein at least one of the handle mount and handle body define a plurality of spaced openings that may be used selectively to interlock the handle mount and handle body in selected relative longitudinal positions.

10. The push plow of claim 8, wherein both of the handle mount and handle body define a plurality of spaced openings, the push plow further comprising a detent mechanism comprising a button clip operable to engaged aligned ones of said plurality of spaced openings to interlock the handle mount and handle body in a selected relatively longitudinal position.

11. The push plow of claim 8, wherein the handle has a first portion and a second portion, and the second portion extends in a direction at an oblique angle relative to the first portion.

12. The push plow of claim 1, further comprising a glide supported on the bottom edge of each of the first and second panels to promote gliding of the push plow over a rough surface.

13. The push plow of claim 12, wherein each glide is constructed of plastic and has a smoothed leading edge to promote gliding of the push plow over the rough surface.

14. The push plow of claim 1, where the plow blade further comprises:

a third panel having respective top and bottom edges, and respective side edges extending between its top and bottom edges, the third panel being pivotably interconnected to the first panel, the third panel being pivotable between a retracted position in which the bottom edges of the first and third panel extend transversely to one another, and an extended position in which the bottom edges of the first and third panel extend in a common direction.

15. A push plow comprising:

a plow blade, the plow blade comprising:

a first panel having top and bottom edges, and side edges extending between the top and bottom edges;

a second panel having respective top and bottom edges, and respective side edges extending between its top and bottom edges, the second panel being pivotably interconnected to the first panel proximally to an intersection of the side and bottom edges of both panels, the second panel being pivotable about an axis normal to a plane of at least a portion of the first panel between a retracted position in which a majority of the second panel overlies the first panel with the bottom edges of the first and second panel extending transversely to one another, and an extended position in which the bottom edges of the first and second panel extend in a common direction; and a handle mounted to the first panel, the handle extending substantially vertically from the first panel when the first panel is in a substantially vertical position;

the handle being mounted to a central portion of the first panel, the second panel being pivotably mounted to the first panel at a side portion of the first panel that is outside the central portion.

16. The push plow of claim 15, wherein the first panel and the second panel are substantially planar.

17. The push plow of claim 15, wherein each of the first and second panels is constructed of corrugated plastic.

18. The push plow of claim 15, wherein the second panel is spring-biased to retain the second panel in at least one of the retracted position and the extended position.

19. The push plow of claim 15, further comprising a glide supported on the bottom edge of each of the first and second panels to promote gliding of the push plow over a rough surface.

20. The push plow of claim 19, wherein each glide is constructed of plastic and has a smoothed leading edge to promote gliding of the push plow over the rough surface.

21. The push plow of claim 15, where the plow blade further comprises:

a third panel having respective top and bottom edges, and respective side edges extending between its top and bottom edges, the third panel being pivotably interconnected to the first panel, the third panel being pivotable between a retracted position in which the bottom edges of the first and third panel extend transversely to one another, and an extended position in which the bottom edges of the first and third panel extend in a common direction.

22. A push plow comprising:

a plow blade, the plow blade comprising:

a first panel having top and bottom edges, and side edges extending between the top and bottom edges;

a second panel having respective top and bottom edges, and respective side edges extending between its top and bottom edges;

a third panel having respective top and bottom edges, and respective side edges extending between its top and bottom edges;

a first pivot joint interconnecting the first and second panels proximally to an intersection of the side and bottom edges of the first and second panels so that the second panel is pivotable about an axis normal to a plane of at least a portion of the first panel between a retracted position in which a majority of the second panel overlies the first panel and the bottom edges of the first and second panel extend transversely to one another, and an extended position in which a majority of the second panel does not overlie the first panel and the bottom edges of the first and second panel extend in a common direction;

a second pivot joint interconnecting the first and third panels proximally to an intersection of the side and bottom edges of the first and third panels so that the third panel is pivotable about an axis normal to a plane of at least a portion of the first panel between a retracted position in which a majority of the third panel overlies the first panel and the bottom edges of the first and third panel extend transversely to one another, and an extended position in which a majority of the third panel does not overly the first panel and the bottom edges of the first and third panel extend in a common direction; and a handle mounted to the first panel, the handle extending substantially vertically from the first panel when the first panel is in a substantially vertical position.

23. The push plow of claim 22, wherein the first panel, the second panel and the third panel are substantially planar.

24. The push plow of claim 22, wherein each of the first, second and third panels is constructed of corrugated plastic.

25. The push plow of claim 22, further comprising a glide supported on the bottom edge of each of the first, second and third panels to promote gliding of the push plow over a rough surface.

26. The push plow of claim 25, wherein each glide is constructed of plastic and has a smoothed leading edge to promote gliding of the push plow over the rough surface.

* * * * *